US005742258A

United States Patent [19]

Kumpfbeck et al.

[11] Patent Number: 5,742,258

[45] Date of Patent: Apr. 21, 1998

[54] LOW INTERMODULATION ELECTROMAGNETIC FEED CELLULAR ANTENNAS

[75] Inventors: Richard J. Kumpfbeck, Huntington; Gary Schay, Stony Brook, both of N.Y.

[73] Assignee: Hazeltine Corporation, Greenlawn, N.Y.

[21] Appl. No.: 518,059

[22] Filed: Aug. 22, 1995

[51] Int. Cl.[6] ..... H01Q 21/10

[52] U.S. Cl. ..... 343/795; 343/700 MS; 343/816; 343/817; 343/822

[58] Field of Search ..... 343/795, 700 MS, 343/810, 812–818, 827, 830, 831, 820, 822; 333/22 R, 33, 35, 245; H01Q 21/00, 21/10

[56] References Cited

U.S. PATENT DOCUMENTS

| | | | |
|---|---|---|---|
| 3,750,185 | 7/1973 | Evans | 343/815 |
| 4,287,518 | 9/1981 | Ellis | 343/795 |
| 4,518,969 | 5/1985 | Bogner | 343/819 |
| 4,825,220 | 4/1989 | Edward et al. | 343/821 |
| 5,274,391 | 12/1993 | Connolly | 343/820 |

FOREIGN PATENT DOCUMENTS

| | | | |
|---|---|---|---|
| AO631343 | 12/1994 | European Pat. Off. | H01Q 21/00 |
| AO688040 | 12/1995 | European Pat. Off. | H01K 9/04 |

OTHER PUBLICATIONS

J.F. Wagen, et al.; Time Dispersion Measurement Using a SSFIP Base Station Antenna; pp. 5–8; Vehicular Technology Society 42nd VTS Conference Frontiers of Technology; May 1–13, 1992; Denver, Colorado.

*Primary Examiner*—Michael C. Wimer
*Attorney, Agent, or Firm*—E. A. Onders; K. P. Robinson

[57] ABSTRACT

A dipole array antenna is configured for improved cellular operation by avoidance of metallic contacts which can lead to generation of intermodulation products (IMP). Isolated rectangular dipole radiators 12–17 are electromagnetically excited by perpendicularly aligned non-contacting exciter resonators 40–45. The rectangular exciter resonators 40–45 are integrally formed with microstrip signal distribution feed 18 supported above a ground plane 22. A non-contact RF grounded termination for the outer conductor of coaxial input line 52 uses a quarter-wave microstrip line section 56 to provide a low impedance RF path to ground to avoid IMP. An RF-isolated DC grounding circuit for surge protection includes a parallel combination of quarter-wave line sections 62 and 66. Line section 66 provides an RF open circuit path to a DC grounding post 67. Line section 62 provides a parallel non-contact low impedance RF path to ground, avoiding IMP from flow of an RF current through pressure contact points at post 67. The low impedance RF path to ground through line section 62 is isolated from the signal distribution line **18*b* of the antenna by the RF open circuit provided by quarter-wave line section 68**.

20 Claims, 6 Drawing Sheets

LOW INTERMODULATION ELECTROMAGNETIC FEED CELLULAR ANTENNAS

This invention relates to array antennas suitable for cellular use and, more particularly, to such antennas wherein intermodulation products affecting cellular use are reduced by elimination of RF current flow through contact points.

BACKGROUND OF THE INVENTION

With the expansion of cellular and other wireless communication services, there is a growing requirement for antennas suitable for communication with cellular telephones and other mobile user equipment. These antennas are typically provided in fixed installations on buildings or other structures in urban and other areas. The characteristic of the use of a large number of contiguous cell coverage areas of relatively small size, particularly in urban installations, results in the need for installation of large numbers of antennas. The need to provide reliable communications service to a population of users moving through coverage areas with varying transmission characteristics places special requirements on the antennas.

While many types of antennas are available for these applications, prior antennas typically have one or more of the following undesirable characteristics: limited performance, high cost, high component count and assembly labor, limited reliability, signal path and grounding connections subject to generating spurious intermodulation effects, and high susceptibility to lightning damage.

Some antenna characteristics are particularly significant in cellular and similar applications. Contacts or physical connections in the signal path and in grounding connections can, over time, degrade and result in spurious intermodulation effects which are unacceptable in many cellular applications. While configurations such as an all brass antenna construction with soldered connections can avoid contacts with resistive or bi-metallic characteristics giving rise to intermodulation effects, such construction may be prohibitively expensive. Cellular applications typically involve broad band operation susceptible to degradation where intermodulation products of the multiple simultaneous transmit signal frequencies interfere with signal reception of the received signal frequencies, for example. Thus, in cellular applications, in particular, there is a growing awareness of intermodulation product (IMP) problems, especially where contact or grounding to an aluminum ground plane is required.

Achieving high performance and reliability with low cost places emphasis on a low component count and ease of production and assembly. Adaptability to a variety of installations and operating requirements is enhanced by a construction with flexible design aspects. Adaptability to beam forming and active antenna beam steering and null control techniques is facilitated by antennas providing multiple beam capabilities. Particularly in urban locations, antenna esthetics and the capability of enabling unobtrusive antenna placement on the sides of buildings are significant objectives. Susceptibility to lightning damage can place systems out of service and result in high costs of antenna replacement.

Objects of this invention are, therefore, to provide new and improved types of dipole array antennas, and antennas having qualities which favorably address one or more of the above-identified characteristics.

Other objects are to provide antennas utilizing one or more of the following configurations in accordance with the invention:

(A) a double tuned radiating/receiving unit formed of the combination of a non-radiating exciter resonator (of rectangular or other shape and typically positioned perpendicular to a ground plane) and a dipole radiator in spaced non-contact relation to an edge of the exciter resonator (the dipole radiator of rectangular or other shape and typically positioned above the exciter resonator and parallel to the ground plane);

(B) a non-contact RF ground arrangement for an input/output coaxial cable, including a quarter-wave section of microstrip line connected to the outer conductor of the coaxial cable; and (C) an RF-isolated DC grounding circuit providing lightning protection by a DC connection to ground, with a parallel non-contact low impedance RF path to ground (which is at the same time isolated from the signal distribution path by an electrical open circuit arrangement).

As will be further described, each of the above configurations (A), (B) and (C) is effective to avoid inclusion of one or more circuit connections subject to intermodulation product problems, while also avoiding high-cost, unreliable construction.

SUMMARY OF THE INVENTION

In accordance with the invention, an electromagnetic exciter feed dipole array antenna, operable over a frequency band, includes a conductive ground plane unit, a microstrip feed assembly and an array of dipole radiators. The microstrip feed assembly includes: a plurality of two-dimensional metallic exciter resonators of rectangular or other shape extending perpendicularly in spaced relationship to the ground plane unit; and a signal distribution portion extending parallel to the ground plane unit from an input/output point to each of the exciter resonators and arranged to feed signals in parallel to the exciter resonators. A plurality of dipole radiators of rectangular or other shape are arranged parallel to the ground plane unit in a linear array. Each dipole radiator is positioned in spaced non-contact relationship to a distal edge of one of said exciter resonators and electromagnetically coupled thereto.

Also in accordance with the invention, an antenna may include a non-contact RF grounded input/output line termination. An input/output coaxial line section has one end of an inner conductor connected to a signal distribution line of the antenna. A quarter-wave section of microstrip line is connected to an outer conductor of the coaxial line section and extends in spaced non-contact relationship to the ground plane of the antenna. The quarter-wave section provides a non-contact low impedance RF path to the ground plane. An electrical connector is connected to the ground plane and connected to a second end of the inner conductor and to the outer conductor of the coaxial line section. The quarter-wave section is thus arranged to provide a low impedance non-contact RF path to ground in parallel to a connector connection to ground.

Further in accordance with the invention, an antenna may include an RF-isolated DC grounding circuit. A first quarter-wave section of microstrip line extends from a common point in spaced non-contact relationship to the ground plane of the antenna. This first quarter-wave section thus provides a non-contact low impedance RF path to the ground plane from such common point. A second quarter-wave section of microstrip line extends from the common point to a DC connection to the ground plane. The second quarter-wave section thus provides a low impedance DC/high impedance RF path to ground from the common point. A third quarter-wave section of microstrip line extends from the common point to a reference point on a signal distribution line of the antenna. With this configuration, the first, second and third quarter-wave sections are arranged to provide a low resistance DC path to ground from the reference point, while at the same time providing a low impedance RF path to ground (for any RF current which might otherwise flow from the reference point to ground via the DC connection).

For a better understanding of the invention, together with other and further objects, reference is made to the accompanying drawings and the scope of the invention will be pointed out in the accompanying claims.

DESCRIPTION OF THE INVENTION

Figures 1, 1A:
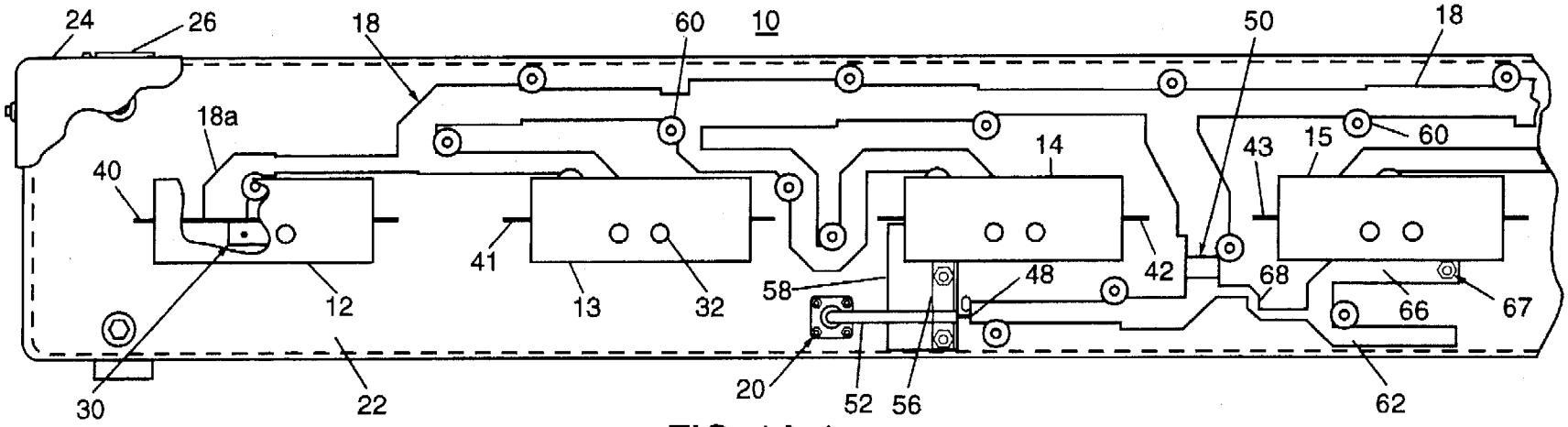
FIGS. 1A (including partial views 1A-1 and 1A-2), 1B and 1C are respectively plan, partial side, and end views of a dipole array antenna including an electromagnetic exciter feed radiating/receiving unit and other features in accordance with the invention.
Figures 1, 1A, 2:
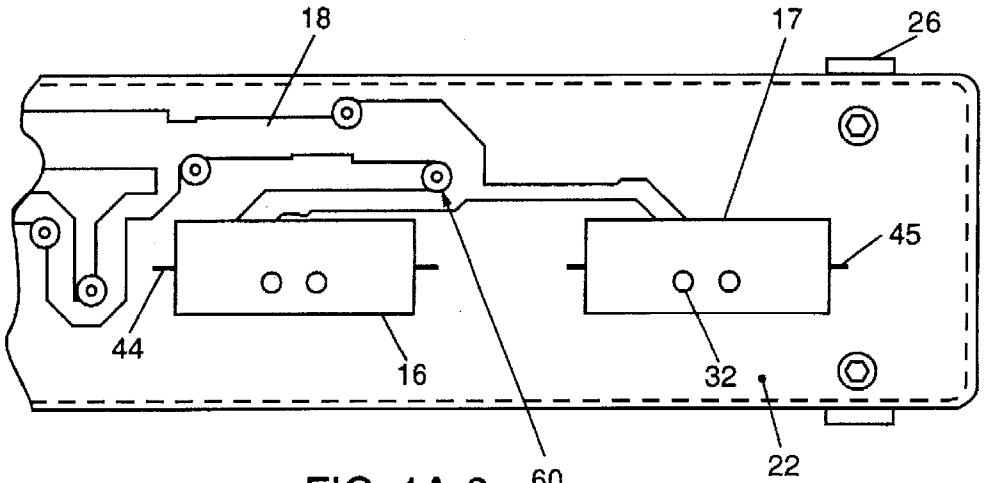
Figure 1B:
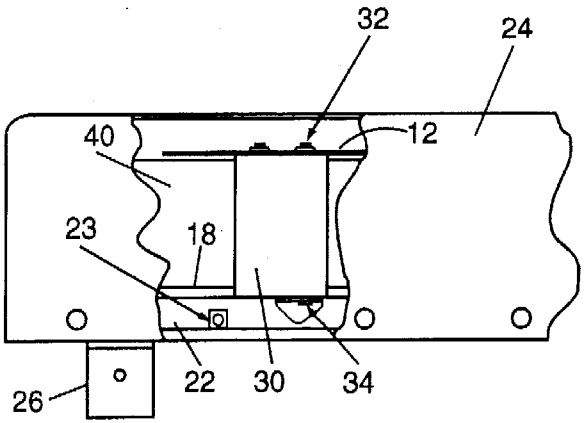
Figure 1C:
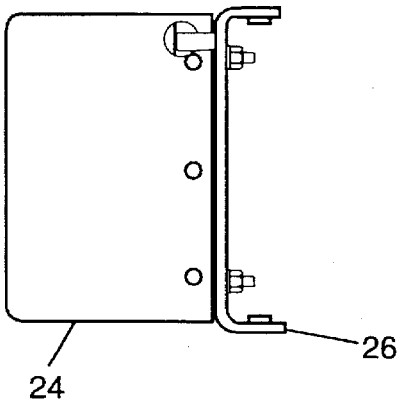

FIGS. 1A, 1B and 1C are plan, partial side and end views, respectively, of an electromagnetic exciter feed dipole array antenna 10 constructed in accordance with the invention. As visible in FIG. 1A, the antenna includes six rectangular dipole radiators 12, 13, 14, 15, 16 and 17, typically cut from thin aluminum stock, which form a linear array. Also visible in FIG. 1A is the signal distribution portion 18 of a microstrip feed assembly, arranged to feed dipole radiators 12–17 in parallel from an electrical connector 20. As shown, connector 20 is mounted to a ground plane unit 22, typically formed of aluminum stock. The microstrip line sections of signal distribution portion 18, typically cut from brass stock, are supported in an air insulated configuration above the upper surface of ground plane unit 22.

Before describing the radiating system components in greater detail, other features of the antenna as shown in FIGS. 1A, 1B and 1C can be noted. As shown, the ground plane unit has a main planar surface, with side and end edge portions bent down to form a structural unit. A dielectric radome 24, partially cut away, is attached by screws or other fasteners to the edge portions at fastener points 23 and extends over the radiating system components. Structural brackets 26 of suitable construction for mounting the antenna 10 in a vertical operational orientation are attached to the underside of ground plane unit 22, at each end. Many structural variations may be employed. For example, embodiments constructed for different beam width characteristics include a ground plane unit with side and end edge portions bent up, rather than down.

Figure 2A:
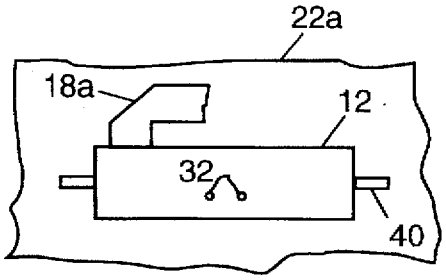
FIGS. 2A, 2B and 2C are simplified plan, side and end views of one double-tuned electromagnetic exciter feed radiating/receiving unit of the FIG. 1A antenna.
Figure 2B:
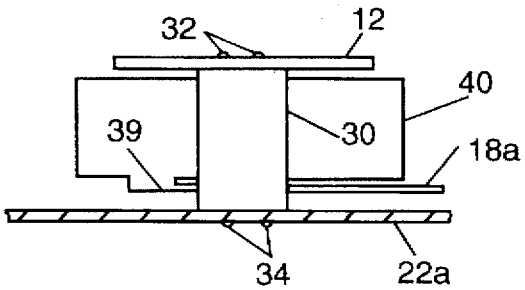
Figure 2C:
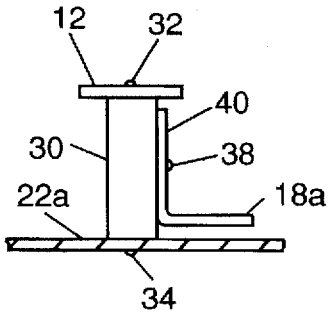

Referring now to FIGS. 2A, 2B and 2C, radiating system components of the radiating/receiving unit incorporating dipole radiator 12 are shown in greater detail, as typical of the configurations associated with each of dipole radiators 12–17. In FIGS. 2A, 2B and 2C relative dimensions have been modified or exaggerated for purposes of increased clarity of depiction of details. The views of FIGS. 2A and 2B correspond to the FIGS. 1A and 1B views of dipole radiator 12 and associated components, and FIG. 1C is an end view thereof.

As represented in FIGS. 2A, 2B and 2C, dipole radiator 12 is a rectangle of thin aluminum stock, or other appropriate conductive material, fastened to the top of a block 30 of dielectric, or other suitable insulative material, by screws 32 or other suitable fastening arrangement. Block 30 is attached to the surface of portion **22*a* of ground plane unit 22, by screws 34 or other suitable fastening arrangement. Also shown in these Figs. is the two-dimensional exciter resonator 40 extending perpendicularly in spaced relationship to the portion 22*a* of the ground plane unit. Exciter resonator 40, which is integrally formed with microstrip line section 18*a* of the signal distribution portion of the feed assembly, may be fastened to the side of block 30 by two screws 38 or other suitable fastening arrangement. As shown, line section 18*a* is positioned above ground plane portion 22*a* by a suitable support arrangement and is integrally formed (typically cut from thin, but structurally stiff, brass stock) in one piece with exciter resonator 40. As indicated, exciter resonator 40 is attached at a limited-width off-center common area 39 to line section 18*a*. After the combination of line section 18*a* and exciter resonator 40 is cut in one piece from the brass stock, exciter resonator 40 is structurally bent up to a position perpendicular or nominally perpendicular to microstrip line section 18*a* (and thereby also perpendicular or nominally perpendicular to the surface of ground plane portion 22*a*). In this embodiment, exciter resonators 41, 42, 43, 44 and 45, portions of which are visible in FIG. 1A extending from beneath dipole radiators 13–17 in FIG. 1A, are identical to exciter resonator 40**. For present purposes, "nominally" means a quantity or relationship is within plus or minus thirty percent of a stated quantity or relationship. Also, "extending perpendicularly" means an element has a dimension along a perpendicular direction and a thin element extending perpendicularly has a principal dimension nominally aligned along a perpendicular direction.

With the foregoing description of the configuration of FIGS. 2A, 2B and 2C it will be seen that the antenna of FIGS. 1A, 1B and 1C is arranged for electromagnetic exciter feed of the dipoles 12–17 and includes a microstrip feed assembly positioned above ground plane unit 22. More particularly, the feed assembly includes a signal distribution portion and exciter resonators, the major portions of which may be cut from a single sheet of brass or other suitable material. As illustrated, the exciter resonators 40–45 are two-dimensional, having a planar rectangular form, the plane of which extends perpendicularly to the ground plane unit 22, and having an edge which is distal from unit 22 and extends parallel to the ground plane unit 22. The signal distribution portion 18 of the feed assembly is air-insulated from ground plane unit 22 and extends from an input/output point 48 to each of the exciter resonators 40–45. As shown, by appropriate proportioning and path lengths, signal distribution portion 18 is arranged to include an arrangement of six line section arms suitable to feed signals to the six exciter resonators 40–45 in parallel. By reciprocity, it will be understood that such arrangement is appropriate for coupling of received signals from the six exciter resonators to input/output point 48 during reception, as well as feeding signals to the exciter resonators during transmission. In the illustrated embodiment the signal distribution portion of the feed assembly was constructed of two pieces of brass stock soldered together at point 50. The upper part of the microstrip line portion 18 in the FIG. 1A depiction was formed in one piece with exciter resonators 40–45 attached. The lower part of the microstrip line portion in the FIG. 1A depiction will be further described with reference to FIGS. 8A, 8B and 9.

Figure 3:
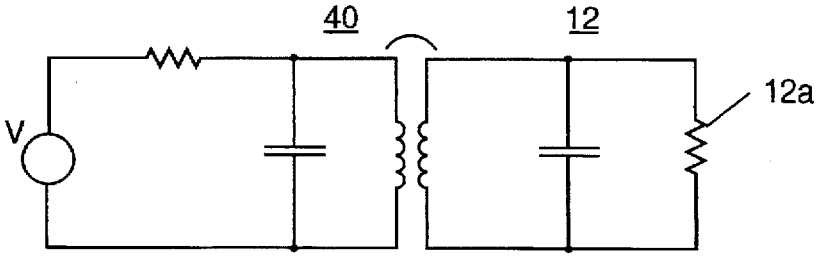
FIG. 3 illustrates the equivalent double tuned circuit configuration providing electromagnetic coupling and broad band frequency characteristics of a dipole radiator/exciter resonator combination of the FIG. 1A antenna.

The electromagnetic exciter feed of the antenna is accomplished by the cooperative combination of the exciter resonators 40–45 with the dipole radiators 12–17, to form double-tuned radiating/receiving units. As shown and described, each of the dipole radiators is positioned in spaced non-contact relationship to one of the exciter resonators. Thus, with the exciter resonators 40–45 each extending normal to the ground plane, each of dipole radiators 12–17 aligned parallel to the ground plane is spaced from the upper edge of an exciter resonator. Each dipole radiator is dimensioned to function as a single-tuned circuit resonant at a frequency in the center of a frequency range of interest (normally the center of the operating frequency band of the antenna). Correspondingly, each exciter resonator is dimensioned to function as a resonant tuned circuit at a selected frequency (normally the same frequency as for the dipole radiators). The exciter resonator differs in not being a physically separate element, but being connected to and fed by the distribution portion of the feed assembly. The corresponding equivalent circuit configuration is represented in FIG. 3. As shown, the circuit of radiator 12 feeding radiation resistance 12*a* is coupled to the circuit of exciter resonator 40 fed by input signals from the feed assembly.

Figure 4:
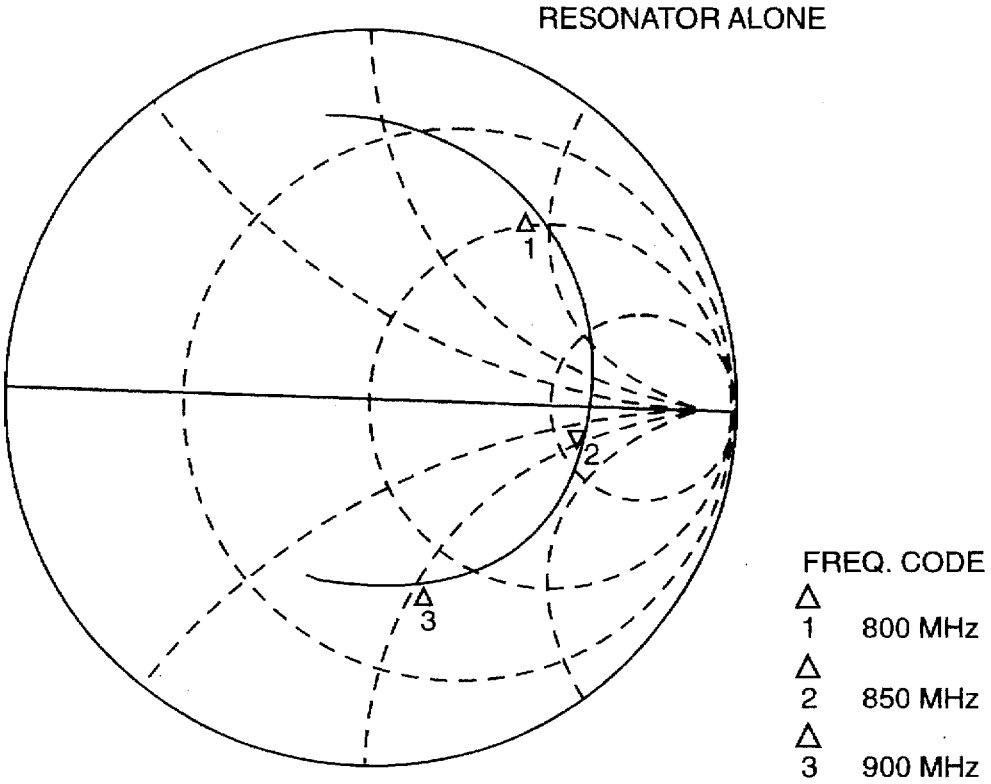
FIG. 4 shows measured impedance of a single exciter resonator of the FIG. 1A antenna in Smith chart format (without associated dipole radiator).
Figure 5:
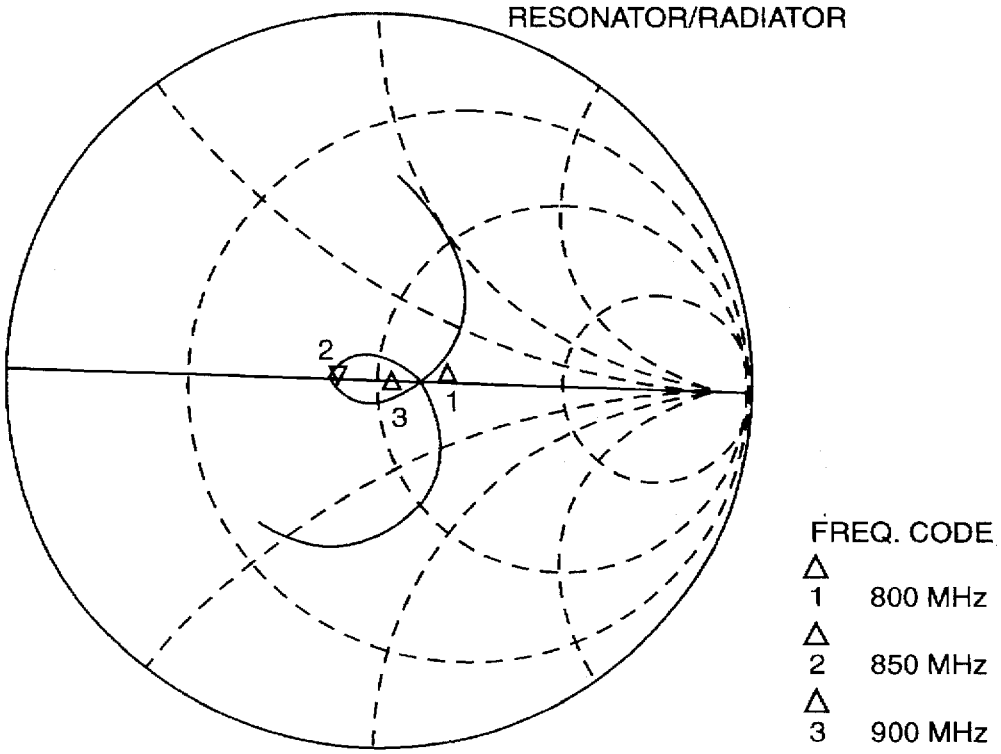
FIG. 5 shows measured impedance of a single exciter resonator/dipole radiator unit of the FIG. 1A antenna in Smith chart format.

In operation, the exciter resonator (e.g., resonator 40) located with relatively close spacing to the conductive ground plane surface does not function as a radiator (except possibly to a negligible degree depending on actual dimensioning). With the close non-contact proximity however, the excitation of the exciter resonator is effective to cause signals to be electromagnetically coupled to the dipole radiator (e.g., dipole 12), which functions as an efficient radiator. FIG. 4 shows, in Smith chart format, measured impedance of a single exciter resonator 40 of the FIG. 1 antenna, with the associated dipole radiator 12 physically removed. As shown, in FIG. 4, the impedance of the exciter resonator is characteristic of a parallel single-tuned circuit, which is a very inefficient radiating element. FIG. 5 shows, also in Smith chart format, measured impedance of a single electromagnetic exciter feed radiating unit of the FIG. 1A antenna, comprising dipole radiator 12 in combination with exciter resonator 40. As shown in FIG. 5, with the dipole radiator positioned to achieve appropriate non-contacting electromagnetic coupling wideband tuning is achieved. As indicated by the FIG. 5 data, this dipole radiator/exciter resonator combination exhibits a low VSWR in the 800 to 900 MHz frequency band and is an efficient radiating/receiving unit.

Figure 6:
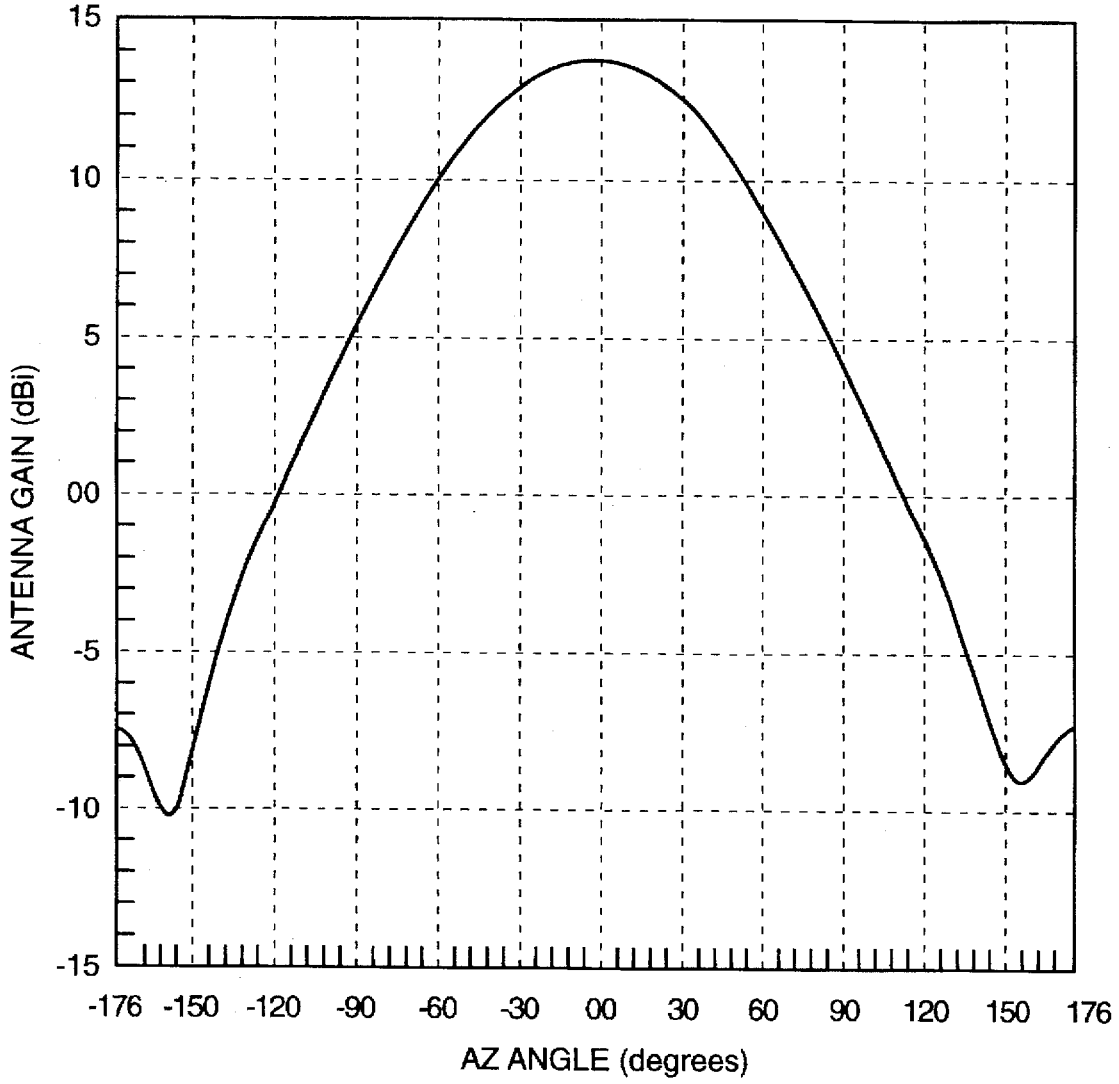
FIG. 6 shows measured antenna gain in dBi vs. azimuth angle in degrees for the antenna pattern of the FIG. 1A antenna.
Figure 7:
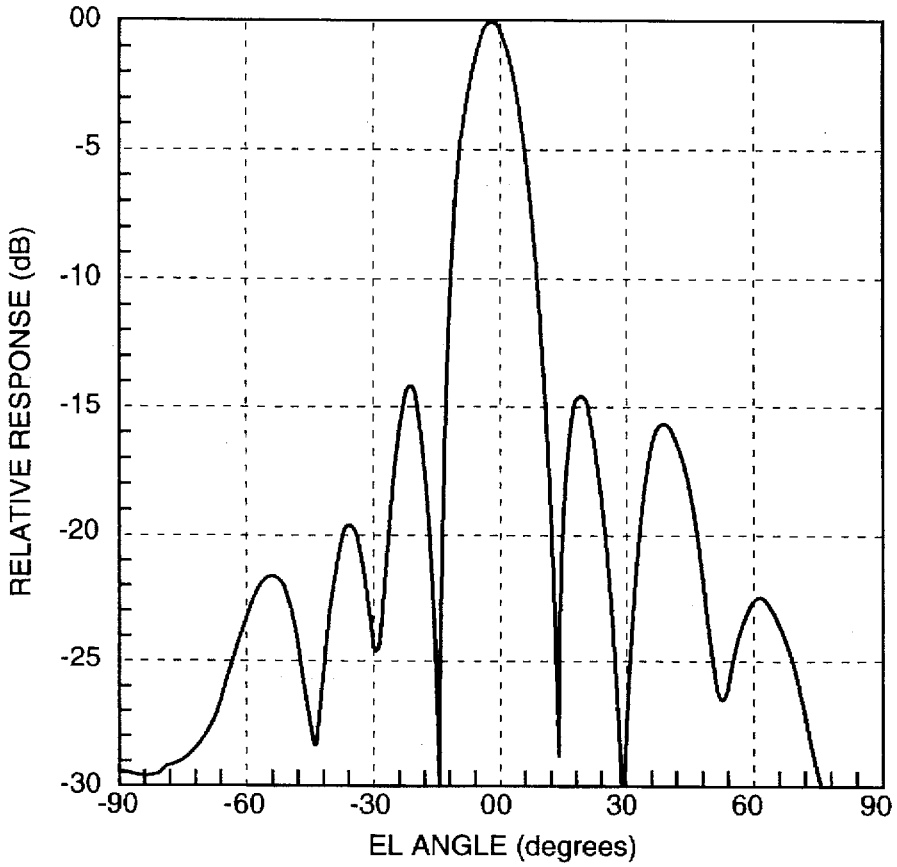
FIG. 7 shows measured relative response in dB vs. elevation angle in degrees for the antenna pattern of the FIG. 1A antenna.

An important feature of the invention is provision of double-tuned performance providing wide band operation as a result of the electromagnetically intercoupled resonant circuits of the dipole radiator and exciter resonator. In accordance with established antenna theory it is known that double-tuned radiating circuits can be arranged to provide operation over a significantly enhanced frequency bandwidth as compared to a common single-tuned radiator. Measured antenna pattern data for operation at 900 MHz is shown in FIGS. 6 and 7 for the antenna illustrated in FIGS. 1A, 1B and 1C. FIG. 6 shows the azimuth pattern for the antenna, providing a beamwidth of approximately 105 degrees at the −3 dB points. FIG. 7 provides measured elevation beamwidth data for the same antenna configuration.

Figure 8A:
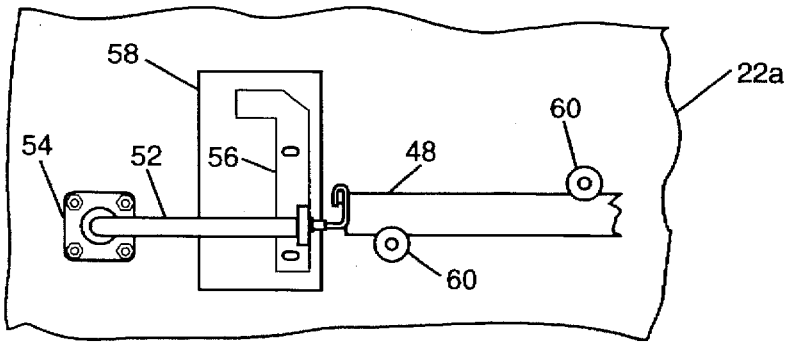
FIGS. 8A and 8B illustrate a non-contact RF grounded termination of the outer conductor of the input coaxial line of the FIG. 1A antenna in accordance with the invention.
Figure 8B:
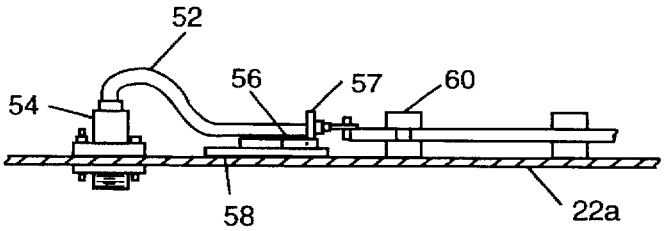

Referring now to FIGS. 8A and 8B, there are shown plan and side views of a non-contact RF grounded input/output line termination usable in the FIG. 1A and other types of antennas. As noted above, intermodulation products arising as a result of non-linear resistance or other properties, especially at contact points between dissimilar metals in ground paths or other signal paths are particularly of concern in many cellular applications.

In an antenna including an internal microstrip type signal distribution line, for example, it is usually necessary to connect the microstrip line to an electrical connector in order to feed signals to and from the antenna. The electrical connector, such as a typical coaxial connector, is commonly fastened directly to a ground level portion of the antenna chassis by screws or other physical attachment. This arrangement provides a DC connection to ground which is suitable in many applications, but which may be a source of intermodulation products (IMP) in cellular applications, either initially or over time as an initially good contact develops non-linear resistive characteristics on exposure to environmental conditions, for example.

In FIGS. 8A and 8B, an input/output coaxial line section 52 is shown connected to an electrical connector 54. As shown, the inner conductor, typically of copper, is soldered to the input/output point 48 of the signal distribution line previously referred to in description of the microstrip line which forms the signal distribution portion of the feed assembly 18 of FIG. 1A. This soldered connection between the similar metals of the inner conductor of coaxial line 52 and the brass microstrip line is normally not of concern relative to origination of intermodulation products. However, the contact area between the outside of connector 54 and surfaces of ground plane 22*a* is subject to development of intermodulation effects, if RF currents flow through that contact area. In the configuration of FIGS. 8A and 8B a low impedance non-contact RF path to ground is provided in parallel to the contact connection between connector 54 and ground plane 22*a*, to thereby minimize RF current flow in the connector to ground connection.

As illustrated, a quarter-wave section 56 of microstrip line is connected to the outer conductor of the coaxial line section 52 and extends in spaced non-contact relationship to the ground plane. The quarter-wave section 56 provides a non-contact low impedance RF path to the ground plane. With this arrangement, intermodulation effects which might arise as a result of a resistance effect in the connector/ground path are avoided, since any RF current which might otherwise give rise to IMP will flow to ground via the parallel path through the quarter-wave section 56. In the illustrated embodiment, this result is enhanced by use of coaxial line section 52 nominally a quarter wavelength long. As a result, the transmission line configuration formed by the outer conductor of the coaxial line 52 spaced above the ground plane 22*a* functions as a quarter-wave section shorted at the connection of the connector shell to ground, and thus appears as an RF open circuit from the point at which quarter-wave microstrip section 56 is soldered to the outer conductor of coaxial line 52. The combination of the high impedance RF path to ground through the connector shell, in parallel with the low impedance RF path to ground through quarter-wave section 56, is effective to minimize RF current flow through the connector/ground connection.

In FIGS. 8A and 8B quarter-wave section 56 is supported on a dielectric spacer 58, fastened in place by screws or other suitable means. Also shown are dielectric support posts 60 fastened to the ground plane and configured to support the brass microstrip line in air-insulated spaced relationship above the ground plane at spaced points. In the arrangement of FIGS. 8A and 8B coaxial line 52 may appropriately be a section of semi-rigid line having a solid copper cylindrical outer conductor to which microstrip line section 56 may be soldered or otherwise connected without giving rise to IMP. In the illustrated embodiment, brass line section 56 includes a tab 57 which is bent up and has a hole through which the end of coaxial line 52 is inserted and soldered in place. While line section 56 has been described as having an electrical length of one-quarter wavelength at a frequency in an operating frequency band, it will be appreciated that line section 56 may have an electrical length nominally equal to any desired multiple of one-quarter wavelength in order to provide the desired low impedance RF coupling path to ground.

Figure 9:
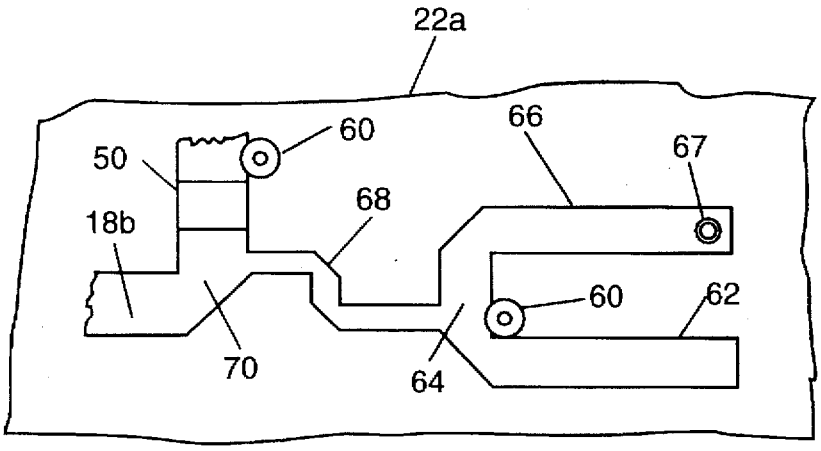
FIG. 9 illustrates an RF-isolated DC grounding circuit coupled to the signal distribution line of the FIG. 1A antenna to provide surge protection in accordance with the invention.

With reference to FIG. 9, there is shown a plan view of an RF-isolated DC grounding circuit usable in the FIG. 1A and other types of antennas. The circuit of FIG. 9 is effective to provide a DC path from a microstrip signal distribution line to ground for lightning and other disturbances, while also avoiding the addition of any connection susceptible to producing IMP.

As illustrated, a first quarter-wave section 62 of microstrip line extends from a common point 64 in spaced non-contact relationship to ground plane 22*a*, with support by support post 60. Line section 62 thus provides a non-contact low impedance RF path to ground from the common point 64. Second quarter-wave section 66 of microstrip line extends from common point 64 to a DC grounding post 67 connected to ground plane 22*a*. Post 67 may be a conductive screw or other suitable device electrically connecting line section 66 and ground 22*a*. Line section 66 thus provides a low impedance DC/high impedance RF path to the ground plane from common point 64, since the shorted quarter-wave section appears as an RF open circuit from point 64 in accordance with well-established circuit principles. A third quarter-wave section 68 extends from the common point 64 to a reference point 70 on the signal distribution line of the antenna and appears as an RF open circuit from point 70.

With the FIG. 9 arrangement in accordance with the invention, the line sections 62, 66 and 68 (each nominally one-quarter wavelength in electrical length or odd multiple thereof) in combination provide: (1) a low resistance DC path to ground from reference point 70 on the signal distribution line, for transient or other DC effects, (2) a low impedance RF path to ground from common point 64 in parallel to the DC path, to avoid IMP from RF signal flow through the DC ground contact, and (3) an open circuit for RF signals from reference point 70 on the signal distribution line, as a result of inclusion of the third quarter-wave section 68.

In an antenna constructed substantially as shown in FIGS. 1A, 1B and 1C, for operation in an 806–894 MHz band, relevant dimensions were approximately as follows: typical dipole 12, 2"×5.2" rectangle of 0.063" aluminum sheet; typical exciter resonator 40, 2.5"×6" rectangle of 0.040" brass sheet; dipole spacing from ground plane, 3"; dipole to dipole spacing, 9"; dipole spacing from edge of associated exciter resonator, 0.10"; and antenna length, 4.6'. For vertical installation, this antenna was configured to provide an antenna pattern with a gain of approximately 13 dB, an azimuth beamwidth of approximately 105 degrees and an elevation beamwidth of approximately 15 degrees. In other configurations and applications antennas in accordance with the invention can be designed to provide antenna patterns of different azimuth beamwidth, by adjusting dipole spacing and ground plane width or configuration, and different elevation beamwidth, by using more or fewer dipoles, for example. The invention may also be applied for use with monopole type radiating elements as well known alternatives to dipoles.

Figure 10:
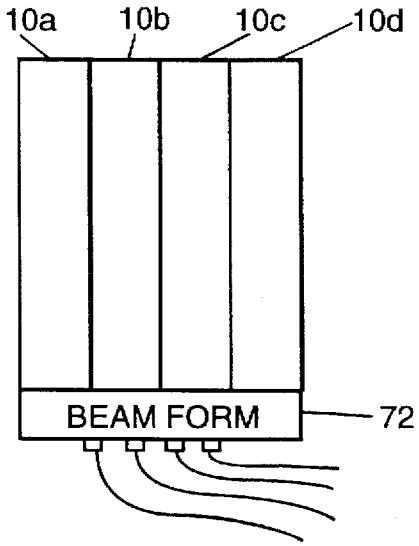
FIG. 10 illustrates use of an array of FIG. 1A type antennas with a beam forming network, in accordance with the invention.

In other applications, two or more of the FIG. 1A type antennas may be used in combination as illustrated in FIG. 10. With reference to FIG. 10, two, three or four of the antennas, indicated as 10*a*, 10*b*, 10*c* and 10*d*, may simply be used in combination to provide an antenna pattern with a narrower beam, higher gain, or both. Alternatively, a beam forming network 72 may be added in known manner for use in achieving fixed or active beam forming operation providing additional capabilities such as beam switching, as well as beam steering and null control.

While there have been described the currently preferred embodiments of the invention, those skilled in the art will recognize that other and further modifications may be made without departing from the invention and it is intended to claim all modifications and variations as fall within the scope of the invention.

What is claimed is:

1. An electromagnetic exciter feed dipole array antenna, operable over a frequency band, comprising:

a conductive ground plane unit;

a microstrip feed assembly including, a plurality of two-dimensional exciter resonators extending perpendicularly in spaced relationship to said ground plane unit, and a signal distribution portion spaced from said ground plane unit, extending from an input/output point to each of said exciter resonators and arranged to feed signals in parallel to said exciter resonators;

a plurality of dipole radiators arranged in a linear array, each said dipole radiator positioned in spaced non-contact relationship to one of said exciter resonators and electromagnetically coupled thereto;

a coaxial line section having one end of an inner conductor connected to said input/output point of said distribution portion of the feed assembly; and a quarter-wave section of microstrip line connected to an outer conductor of said coaxial line section and extending in spaced non-contact relationship to said ground plane unit, said quarter-wave section providing a non-contact low impedance RF path to said ground plane unit.

2. A dipole array antenna as in claim 1, additionally comprising:

an electrical connector mounted to said ground plane unit and connected to a second end of said inner conductor and to said outer conductor of the coaxial line section.

3. A dipole array antenna as in claim 1, wherein said quarter-wave section has an electrical length nominally equal to an odd multiple of one-quarter wavelength at a frequency in said frequency band.

4. A dipole array antenna as in claim 1, wherein said quarter-wave section is supported on a dielectric spacer mounted to said ground plane unit.

5. A dipole array antenna as in claim 1, wherein each of said exciter resonators comprises a planar rectangular portion nominally perpendicular to said ground plane unit.

6. A dipole array antenna as in claim 1, wherein each said dipole radiator consists of a thin metallic two-dimensional element positioned in nominally parallel relationship to said ground plane unit by a dielectric support member.

7. A dipole array antenna as in claim 5, wherein each said dipole radiator is a planar rectangle of sheet metal positioned in non-contacting spaced relation to a distal edge of an exciter resonator, with the plane of said dipole radiator nominally perpendicular to the plane of said exciter resonator.

8. A dipole array antenna as in claim 1, additionally comprising an RF-isolated DC grounding circuit, including:

a first quarter-wave section of microstrip line extending from a common point in spaced non-contact relationship to said ground plane unit, said first quarter-wave section providing a non-contact low impedance RF path to said ground plane unit from said common point;

a second quarter-wave section of microstrip line extending from said common point to a DC connection to said ground plane unit, said second quarter-wave section providing a low impedance DC/high impedance RF path to said ground plane unit from said common point; and a third quarter-wave section of microstrip line extending from said common point to a reference point on said signal distribution portion of said feed assembly;

said first, second and third quarter-wave sections arranged to provide a low resistance DC path to ground from said reference point and a low impedance RF path to ground for any RF current which might otherwise flow from said reference point to said DC connection.

9. An electromagnetic exciter feed dipole array antenna, operable over a frequency band, comprising:

a conductive ground plane unit;

a microstrip feed assembly including, a plurality of two-dimensional exciter resonators extending perpendicularly in spaced relationship to said ground plane unit, and a signal distribution portion spaced from said ground plane unit, extending from an input/output point to each of said exciter resonators and arranged to feed signals in parallel to said exciter resonators;

a plurality of dipole radiators arranged in a linear array, each said dipole radiator positioned in spaced non-contact relationship to one of said exciter resonators and electromagnetically coupled thereto; and an RF-isolated DC grounding circuit, including:

a first quarter-wave section of microstrip line extending from a common point in spaced non-contact relationship to said ground plane unit,, said first quarter-wave section providing a non-contact low impedance RF path to said ground plane unit from said common point;

a second quarter-wave section of microstrip line extending from said common point to a DC connection to said ground plane unit, said second quarter-wave section providing a low impedance DC/high impedance RF path to said ground plane unit from said common point; and a third quarter-wave section of microstrip line extending from said common point to a reference point on said signal distribution portion of said feed assembly;

said first, second and third quarter-wave sections arranged to provide a low resistance DC path to ground from said reference point and a low impedance RF path to ground for any RF current which might otherwise flow from said reference point to said DC connection.

10. A dipole array antenna as in claim 9, wherein each of said quarter-wave sections has an electrical length nominally equal to an odd multiple of one-quarter wavelength at a frequency in said frequency band.

11. A dipole array antenna as in claim 9, wherein each of said exciter resonators comprises a planar rectangular portion nominally perpendicular to said ground plane unit.

12. A dipole array antenna as in claim 9, wherein each said dipole radiator consists of a thin metallic two-dimensional element positioned in nominally parallel relationship to said ground plane unit by a dielectric support member.

13. A dipole array antenna as in claim 11, wherein each said dipole radiator is a planar rectangle of sheet metal positioned in non-contacting spaced relation to a distal edge of an exciter resonator, with the plane of said dipole radiator nominally perpendicular to the plane of said exciter resonator.

14. In an antenna operable over a frequency band and having a ground plane, a non-contact RF grounded input/output line termination comprising:

an input/output coaxial line section having one end of an inner conductor connected to a signal distribution line of said antenna;

a quarter-wave section of microstrip line connected to an outer conductor of said coaxial line section and extending in spaced non-contact relationship to said ground plane, said quarter-wave section providing a non-contact low impedance RF path to said ground plane; and an electrical connector connected to said ground plane and connected to a second end of said inner conductor and to said outer conductor of the coaxial line section;

said quarter-wave section arranged to provide a low impedance non-contact RF path to ground in parallel to said connector connection to said ground plane.

15. An antenna including an input/output line termination as in claim 12, wherein said quarter-wave section has an electrical length nominally equal to an odd multiple of one-quarter wavelength at a frequency in said frequency band.

16. An antenna including an input/output line termination as in claim 12, wherein said quarter-wave section is soldered to the outer conductor of said coaxial line section and supported on a dielectric spacer mounted to said ground plane.

17. An antenna including an input/output line termination as in claim 14, wherein said coaxial line section has an electrical length nominally equal to an odd multiple of one-quarter wavelength at a frequency in said frequency band.

18. In an antenna operable over a frequency band and having a ground plane, an RF-isolated DC grounding circuit comprising:

a first quarter-wave section of microstrip line extending from a common point in spaced non-contact relationship to said ground plane, said first quarter-wave section providing a non-contact low impedance RF path to said ground plane from said common point;

a second quarter-wave section of microstrip line extending from said common point to a DC connection to said ground plane, said second quarter-wave section providing a low impedance DC/high impedance RF path to said ground plane from said common point; and a third quarter-wave section of microstrip line extending from said common point to a reference point on a signal distribution line of said antenna;

said first, second and third quarter-wave sections arranged to provide a low impedance DC path to ground from said reference point and a low impedance RF path to ground for any RF current which might otherwise flow from said reference point to said DC connection.

19. An antenna including an RF-isolated DC grounding circuit as in claim 18, wherein each of said quarter-wave sections has an electrical length nominally equal to an odd multiple of one-quarter wavelength at a frequency in said frequency band.

20. An antenna including an RF-isolated DC grounding circuit as in claim 18, wherein said DC connection comprises a conductive screw grounding said second quarter-wave section to said ground plane.

* * * * *